US007309114B2

(12) United States Patent
Lin

(10) Patent No.: US 7,309,114 B2
(45) Date of Patent: Dec. 18, 2007

(54) CABINET WITH A SAFETY DEVICE

(76) Inventor: Ching-Hsiang Lin, No. 6, Alley 1, Lane 3-22, Anlin Rd., Taichung City (TW)

( * ) Notice: Subject to any disclaimer, the term of this patent is extended or adjusted under 35 U.S.C. 154(b) by 149 days.

(21) Appl. No.: 11/342,809

(22) Filed: Jan. 31, 2006

(65) Prior Publication Data

US 2007/0176523 A1 Aug. 2, 2007

(51) Int. Cl.
*E05C 9/14* (2006.01)

(52) U.S. Cl. ..... 312/221; 312/217; 312/219; 312/334.44

(58) Field of Classification Search ..... 312/217, 312/219, 221, 218, 220, 334.44, 334.8
See application file for complete search history.

(56) References Cited

U.S. PATENT DOCUMENTS 2,240,067 A * 4/1941 Bolesky et al. ..... 312/221
2,882,112 A * 4/1959 Jarvi ..... 312/221
2,886,392 A * 5/1959 Stegmaier ..... 312/217
3,589,783 A * 6/1971 Studinski et al. ..... 312/127
4,303,287 A * 12/1981 Taplin ..... 312/215
6,082,839 A * 7/2000 Chiku ..... 312/219
6,186,606 B1 * 2/2001 Krei ..... 312/221
6,779,855 B2 * 8/2004 Hoffman ..... 312/219
2003/0141790 A1 * 7/2003 Weng ..... 312/217

* cited by examiner

*Primary Examiner*—Janet M. Wilkens
*Assistant Examiner*—Mart K Kuhn
(74) *Attorney, Agent, or Firm*—Rosenberg, Klein & Lee

(57) ABSTRACT

A cabinet has a housing, multiple tracks, multiple drawers, a safety device and a lock assembly. Each track has a sliding rail having a guiding notch and a locking hole. The safety device is mounted in the housing and has a fixed base, a moving base, multiple guiding blocks, multiple locking blocks, multiple guiding brackets and multiple sliders. The guiding blocks are securely attached to the moving base and each have an inclined face. The locking blocks are securely attached to the moving base and each have a locking tab selectively engaging with a corresponding locking hole. The guiding brackets are attached to the fixed base and each have a guiding slot laterally defined through the guiding bracket. Each slider has a top abutting with a corresponding inclined face and a pin engaging with a corresponding guiding notch.

4 Claims, 6 Drawing Sheets

CABINET WITH A SAFETY DEVICE

BACKGROUND OF THE INVENTION

1. Field of the Invention

The present invention relates to a cabinet, and more particularly to a cabinet with a safety device to keep drawers from sliding out unintentionally.

2. Description of Related Art

With reference to FIG. 6, a conventional tool cabinet substantially comprises a housing (70), multiple drawers (71) to store tools inside and multiple wheels (72) attached to the housing (70) to allow the cabinet to move conveniently.

However, the drawers (71) may slide out accidentally while the cabinet is moving, the tools inside the drawers (71) may be scattered over a floor and persons near the cabinet may be injured. Therefore, a safety device is mounted on a cabinet to keep the drawers (71) from sliding out unintentionally. However, when the safety device is unlocked, all of the drawers (71) are at a unlocked condition and a user can open multiple drawers (71) simultaneously. When multiple drawers (71) are opened simultaneously, the center of gravity of the cabinet will be shifted and the cabinet easy turns over and results dangers to the 9 user.

To overcome the shortcomings, the present invention tends to provide a cabinet to mitigate or obviate the aforementioned problems.

SUMMARY OF THE INVENTION

The main objective of the invention is to provide a cabinet that can keep the drawers from sliding out unintentionally and allows only one drawer to be opened at one time. The cabinet has a hollow housing, multiple tracks, multiple drawers, multiple wheels, a safety device and a lock assembly. The tracks are attached respectively to sides of the housing in parallel and are arranged in pairs. Each track comprises a securing rail securely attached the housing and a sliding rail slidably mounted on the securing rail. The sliding rail has a top, a bottom, a guiding notch defined in the top and a locking hole defined through the bottom. The drawers are mounted respectively between the sliding rails of corresponding pairs of the tracks. The wheels are attached to the bottom of the housing. The safety device is mounted in the housing and comprises a fixed base, a moving base, multiple guiding blocks, multiple locking blocks, multiple guiding brackets and multiple sliders. The fixed base is elongated and is longitudinally attached to one side of the housing. The moving base is slidably mounted on the fixed base and has a hole defined through the moving base. The guiding blocks are securely attached to the moving base and correspond respectively to the tops of the sliding rails of the tracks on the side of the housing on which the safety device is mounted. Each guiding block has a bottom and an inclined face defined in the bottom. The locking blocks are securely attached to the moving base and correspond respectively to the bottoms of the sliding rails of the tracks on the side of the housing on which the safety device is mounted. Each locking block has a top and a locking tab formed on the top and selectively engaging with the locking hole in a corresponding sliding rail. The guiding brackets are attached to the fixed base and correspond respectively to the tracks on the side of the housing on which the safety device is mounted. Each guiding bracket has a guiding slot laterally defined through the guiding bracket. The sliders are slidably and respectively mounted on the guiding slots in the guiding brackets. Each slider has a top abutting with the inclined face on a corresponding guiding block and a pin extending from the slider and engaging with the guiding notch in the sliding rail of a corresponding track. The lock assembly is attached to the housing, corresponds to the safety device and has a lock cylinder attached to the housing and having a locking bolt rotatably extending into the hole in the moving base.

Other objects, advantages and novel features of the invention will become more apparent from the following detailed description when taken in conjunction with the accompanying drawings.

DETAILED DESCRIPTION OF PREFERRED EMBODIMENT

Figure 1:
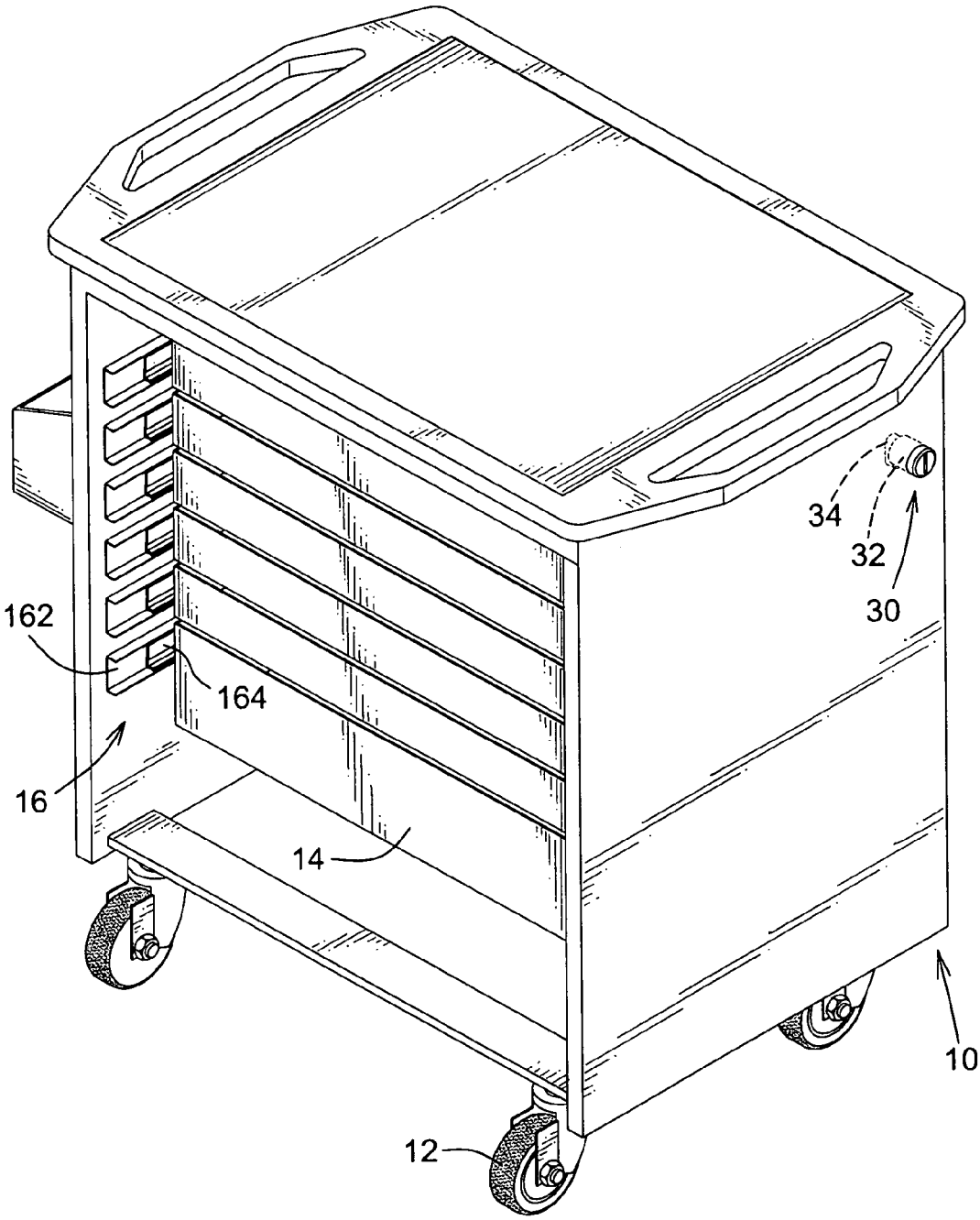
FIG. 1 is a perspective view of a cabinet in accordance with the present invention.
Figure 2:
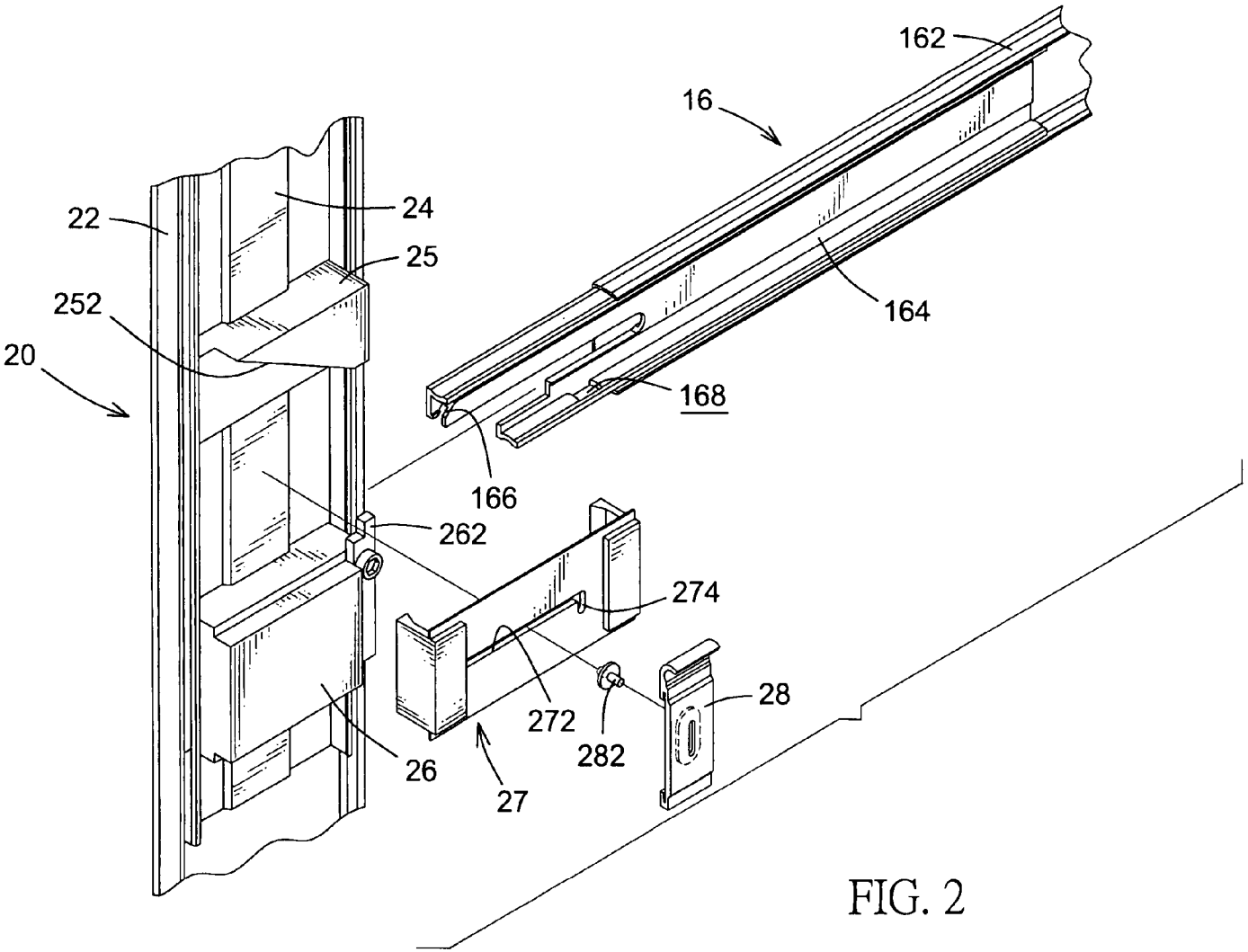
FIG. 2 is an exploded perspective view of the safety device and one track of the cabinet in FIG. 1.

With reference to FIGS. 1 and 2, a cabinet in accordance with the present invention comprises a housing (10), multiple tracks (16), multiple drawers (14), multiple wheels (12), a safety device (20) and a lock assembly (30).

The housing (10) is hollow and has two sides, a bottom and an open front. The tracks (16) are attached respectively to the sides of the housing (10) in parallel and are arranged in pairs. Each track (16) comprises a securing rail (162) securely attached the housing (10) and a sliding rail (164) slidably mounted on the securing rail (162). The sliding rail (164) has top, a bottom, a guiding notch (166) defined in the top and a locking hole (168) defined through the bottom. In a preferred embodiment, each guiding notch (166) extends along an inclined direction. The drawers (14) are mounted respectively between the sliding rails (164) of corresponding pairs of the tracks (16). The wheels (12) are attached to the bottom of the housing (10) to allow the cabinet to be moved conveniently.

The safety device (20) is mounted in the housing (10) and comprises a fixed base (22), a moving base (24), multiple guiding blocks (25), multiple locking blocks (26), multiple guiding brackets (27) and multiple sliders (28). The fixed base (22) is elongated and is longitudinally attached to one side of the housing (10).

Figure 5:
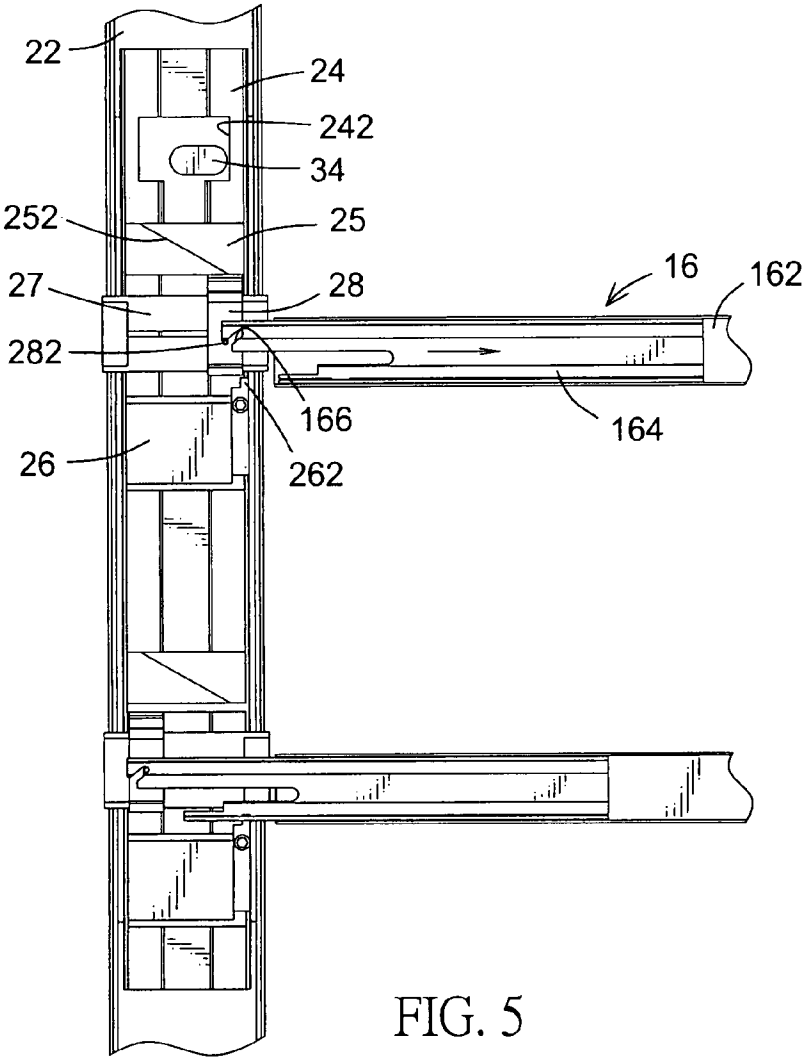
FIG. 5 is an operational side plan view of the safety device and the track of the cabinet in FIG. 2 showing that the other drawers are in a locked condition when a drawer is opened.
Figure 6:
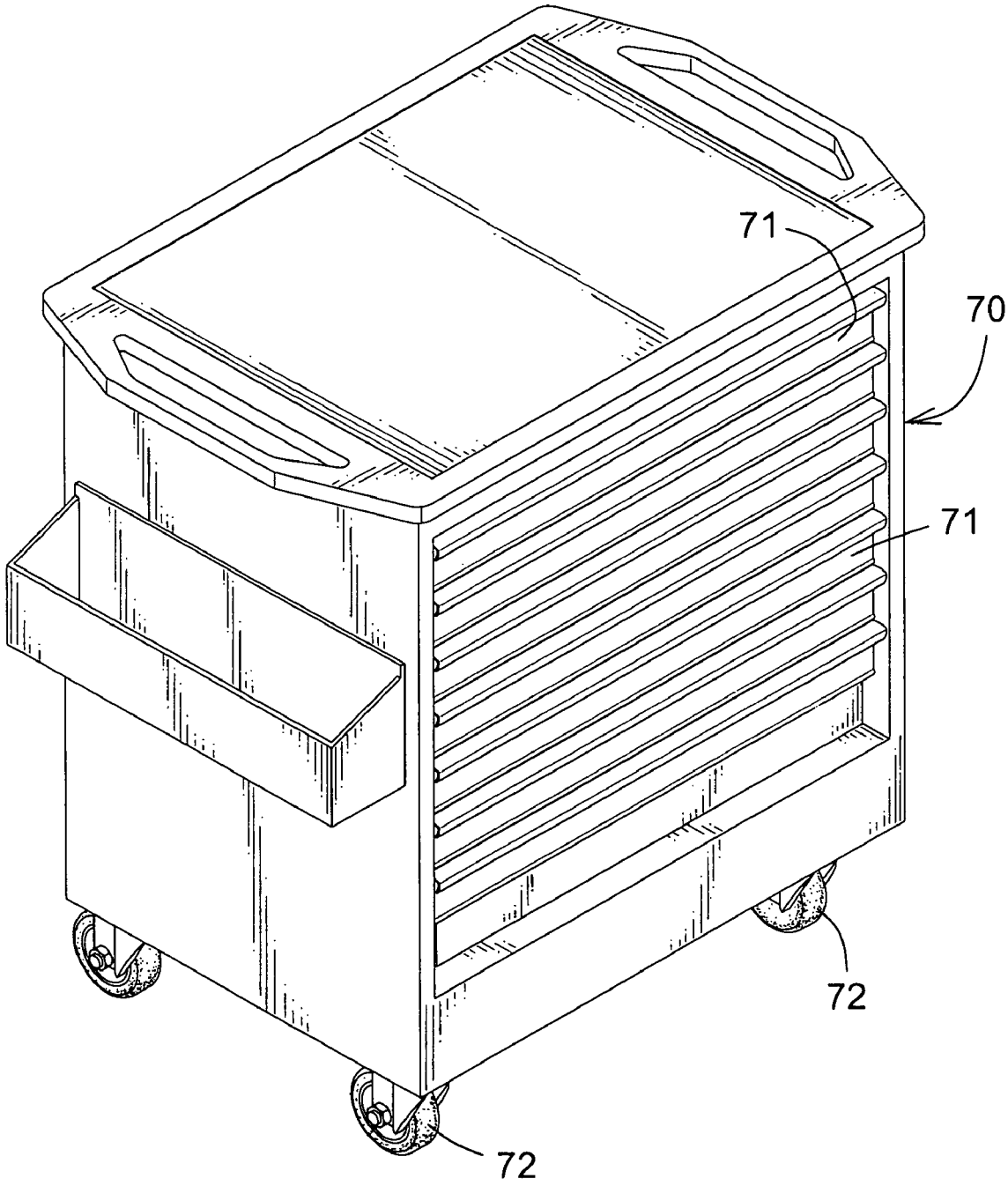
FIG. 6 PRIOR ART
FIG. 6 is a perspective view of a conventional cabinet in accordance with the prior art.

The moving base (24) is slidably mounted on the fixed base (22). With further reference to FIG. 5, the moving base (24) has a hole (242) defined through the moving base (24).

The guiding blocks (25) are securely attached to the moving base (24) and correspond respectively to the tops of the sliding rails (164) of the tracks (16) on the side of the housing (10) on which the safety device (20) is mounted. Each guiding block (25) has a bottom and an inclined face (252) defined in the bottom.

The locking blocks (26) are securely attached to the moving base (24) and correspond respectively to the bottoms of the sliding rails (164) of the tracks (16) on the side of the housing (10) on which the safety device (20) is mounted. Each locking block (26) has a top and a locking tab (262) formed on the top and selectively engaging with the locking hole (168) in a corresponding sliding rail (164).

The guiding brackets (27) are attached to the fixed base (22), are mounted over the moving base (24) and correspond respectively to the tracks (16) on the side of the housing (10) on which the safety device (20) is mounted. Each guiding bracket (27) has a guiding slot (272) laterally defined through the guiding bracket (27) and has a cavity (274) defined in the guiding slot (272) at an end near the corresponding sliding rail (164).

The sliders (28) are slidably and respectively mounted on the guiding slots (272) in the guiding brackets (27). Each slider (28) has a top abutting with the inclined face (252) on a corresponding guiding block (25) and a pin (282) extending from the slider (28), slidably held in the guiding slot (272) and engaging with the guiding notch (166) in the sliding rail (164) of a corresponding track (16).

The lock assembly (30) is attached to the housing (10), corresponds to the safety device (20) and has a lock cylinder (32). The lock cylinder (32) is attached to the housing (10) and has a locking bolt (34) rotatably extending into the hole (242) in the moving base (24).

Figure 3:
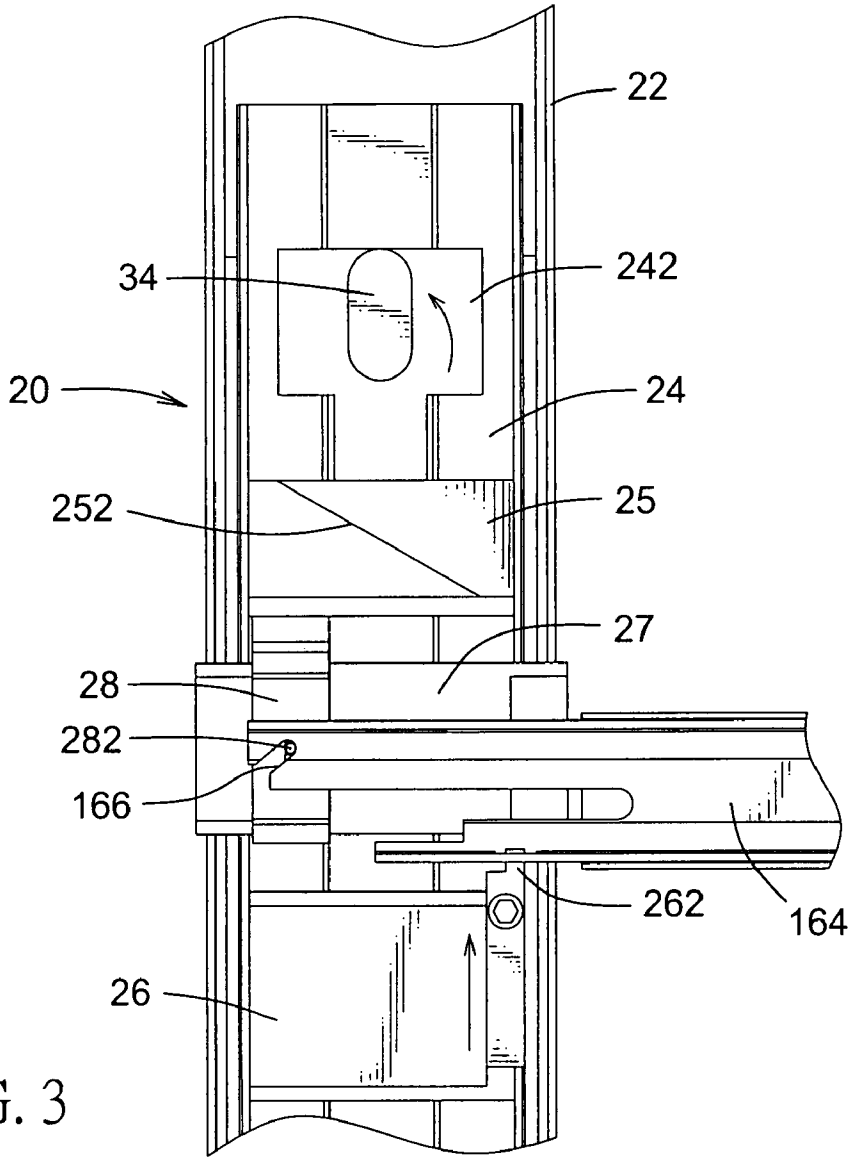
FIG. 3 is an operational side plan view of the safety device of the cabinet in FIG. 2.

With further reference to FIG. 3, when a key is inserted into and rotates the lock cylinder (32), the rotated locking bolt (34) will push the moving base (24) to move upward relative to the fixed base (22). Accordingly, the locking tabs (262) on the locking blocks (26) are inserted respectively into the locking holes (168) in the sliding rails (164) of the tracks (16). With the engagements between the locking tabs (262) and the locking holes (168), the sliding rails (164) of the tracks (16) are locked and cannot slide along the securing rails (162). Accordingly, a locking effect is provided to the drawers (14), and the drawers (14) cannot be opened. Therefore, the drawers (14) will not slide out unintentionally while the cabinet is moved, and this can keep persons near the cabinet from being injured.

Figure 4:
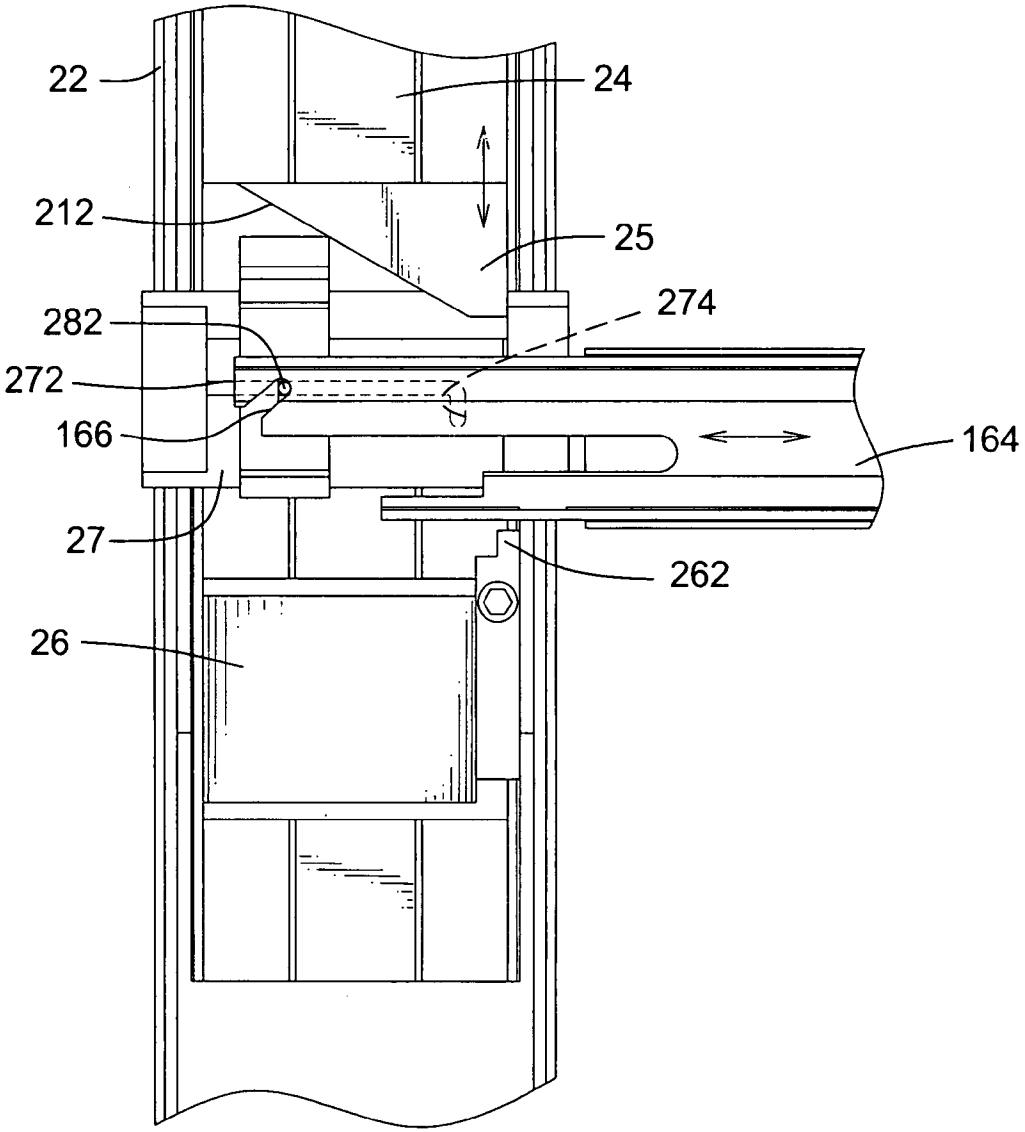
FIG. 4 is an operational side plan view of the safety device and the track of the cabinet in FIG. 2.

With reference to FIGS. 4 and 5, when the key is rotated to unlock the lock cylinder (32), the locking bolt (34) is rotated to a position where not supporting the moving base (24) and the moving base (24) moves downward with the weight of the moving base (24) and the blocks (25,26) on the moving base (24). With the downward movement of the moving base (24), the locking tabs (262) on the locking blocks (26) will disengage from the locking holes (168) in the sliding rails (164) to unlock the tracks (16). Consequently, the user can open one of the drawers (14) to use tools inside the drawer (14). When the user pulls one of the drawers (14) out from the open front of the housing (10), the sliding rails (164) attached to the pulled drawer (14) will slide relative to the securing rails (162). Thus, the pulled sliding rail (164) will move the corresponding slider (28) to slide along the guiding slot (272) in the corresponding guiding bracket (27) with the engagement of the pin (282) on the slider (28) and the guiding notch (166) in the sliding rail (164). The pin (282) will be held inside the cavity (274) in the guiding slot (272) to keep the pulled drawer (14) at an opened condition in stable.

When the slider (28) moves along the guiding slot (272), the top of slider (28) will move along the inclined face (252) on the corresponding guiding block (25) and push the guiding block (25) to move upward. Consequently, the moving base (24) with the locking blocks (26) will be also pushed to move upward, such that the locking tabs (262) will be inserted into and engaged with the locking holes (168) in the unmoved sliding rails (164). Accordingly, the other drawers (14) will not be opened due to the engagement of the locking tabs (262) and the locking holes (168). Therefore, only one drawer (14) can be opened at one time, and this can keep multiple drawers (14) from being opened simultaneously and the center of the gravity of the cabinet from shifting.

When the opened drawer (14) is pushed back into the housing (10), the moving base (24) will move downward with gravity due to without the supporting effect provided by the guiding bracket (28). Consequently, the locking tabs (262) on the locking blocks (26) will disengage from the locking holes (168) in the sliding rails (164), such that the user can open another drawer (14) to take and use tools inside.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cabinet comprising:

a hollow housing having two sides and a bottom;

multiple tracks attached respectively to the sides of the housing in parallel and arranged in pairs and each track comprising a securing rail securely attached to the housing and a sliding rail slidably mounted on the securing rail and having a top, a bottom, a guiding notch defined in the top and a locking hole defined through the bottom;

multiple drawers mounted respectively between the sliding rails of corresponding pairs of the tracks;

multiple wheels attached to the bottom of the housing;

a safety device mounted in the housing and comprising an elongated fixed base longitudinally attached to one side of the housing;

a moving base slidably mounted on the fixed base and having a hole defined through the moving base;

multiple guiding blocks securely attached to the moving base and corresponding respectively to the tops of the sliding rails of the tracks on the side of the housing on which the safety device is mounted, and each guiding block having a bottom and an inclined face defined in the bottom;

multiple locking blocks securely attached to the moving base and corresponding respectively to the bottoms of the sliding rails of the tracks on the side of the housing on which the safety device is mounted, and each locking block having a top and a locking tab formed on the top and selectively engaging with the locking hole in a corresponding sliding rail;

multiple guiding brackets attached to the fixed base and corresponding respectively to the tracks on the side of the housing on which the safety device is mounted, and each guiding bracket having a guiding slot laterally defined through the guiding bracket; and multiple sliders slidably and respectively mounted on the guiding slots in the guiding brackets and each having a top abutting with the inclined face on a corresponding guiding block and a pin extending from the slider, slidably held in the guiding slot in a corresponding guiding bracket and engaging with the guiding notch in the sliding rail of a corresponding track; and a lock assembly attached to the housing, corresponding to the safety device and having a lock cylinder attached to the housing and having a locking bolt rotatably extending into the hole in the moving base.

2. The cabinet as claimed in claim 1, wherein each guiding slot has a cavity defined in the guiding slot at an end near a corresponding sliding rail.

3. The cabinet as claimed in claim 2, wherein each guiding notch extends along an inclined direction.

4. The cabinet as claimed in claim 1, wherein each guiding notch extends along an inclined direction.

* * * * *